US011358166B2

(12) United States Patent
Fuller et al.

(10) Patent No.: US 11,358,166 B2
(45) Date of Patent: Jun. 14, 2022

(54) EXPANDING NOZZLE FOR COMPONENT ADDITIONS IN A CONCRETE TRUCK, AND METHOD AND SYSTEM FOR USE OF SAME

(71) Applicant: GCP Applied Technologies Inc., Cambridge, MA (US)

(72) Inventors: Andrew Fuller, Windham, NH (US); John Aho, Lunenburg, MA (US); James Bleck, Chelmsford, MA (US); Mark F. Roberts, North Andover, MA (US)

(73) Assignee: GCP Applied Technologies Inc., Cambridge, MA (US)

( * ) Notice: Subject to any disclaimer, the term of this patent is extended or adjusted under 35 U.S.C. 154(b) by 352 days.

(21) Appl. No.: 16/616,365

(22) PCT Filed: May 21, 2018

(86) PCT No.: PCT/US2018/033685
§ 371 (c)(1),
(2) Date: Nov. 22, 2019

(87) PCT Pub. No.: WO2018/217641
PCT Pub. Date: Nov. 29, 2018

(65) Prior Publication Data

US 2020/0101477 A1 Apr. 2, 2020

Related U.S. Application Data

(60) Provisional application No. 62/510,908, filed on May 25, 2017.

(51) Int. Cl.

| | |
|---|---|
| ***B05B 7/14*** | (2006.01) |
| ***B28C 7/12*** | (2006.01) |
| ***B05B 15/528*** | (2018.01) |

(52) U.S. Cl.
CPC ..... *B05B 7/1495* (2013.01); *B05B 15/528* (2018.02); *B28C 7/128* (2013.01)

(58) Field of Classification Search
CPC . B05B 7/1495; B05B 15/5225; B05B 15/528; B05B 15/55; B05B 15/555;
(Continued)

(56) References Cited

U.S. PATENT DOCUMENTS

| | | | |
|---|---|---|---|
| 2,368,402 | A | 1/1945 | Ball et al. |
| 2,655,178 | A | 10/1953 | Sarosdy |

(Continued)

FOREIGN PATENT DOCUMENTS

| | | | |
|---|---|---|---|
| DE | 8609004 | | 8/1986 |
| JP | 2001-248207 | A | 9/2001 |

(Continued)

OTHER PUBLICATIONS

Japanese communication, with English translation, dated Feb. 9, 2022 in corresponding Japanese patent application No. 2019-565336.

*Primary Examiner* — Ryan A Reis
(74) *Attorney, Agent, or Firm* — Craig K. Leon

(57) ABSTRACT

A nozzle, including a support member and a nozzle boot surrounding at least a portion of the support member, the nozzle boot having a nozzle boot inlet and a nozzle boot outlet spaced from the nozzle boot inlet and a volume between the nozzle boot inlet and the nozzle boot outlet, the nozzle boot being expandable upon the introduction of fluid into the volume, and collapsible upon withdrawal of fluid from the volume. Also disclosed is a method of removing unwanted concrete from a surface by creating tensile stress to concrete adhered to that surface by causing the surface to expand, and a system for injecting fluid (s) into a rotating drum.

14 Claims, 9 Drawing Sheets

(58) Field of Classification Search
CPC ..... B28C 5/4231; B28C 7/128; B08B 3/02; B08B 9/0813
See application file for complete search history.

(56) References Cited

U.S. PATENT DOCUMENTS 2,828,765 A * 4/1958 Hilkemeier ..... B28C 7/128 137/512.4
2,831,620 A * 4/1958 Schlicksupp ..... B65D 47/2081 222/517
4,008,093 A 2/1977 Kitsuda
4,114,950 A 9/1978 Cooper et al.
4,144,950 A 3/1979 Moyer et al.
4,544,275 A 10/1985 Hudelmaier
5,429,277 A * 7/1995 Kopp ..... B01F 25/313 222/145.6
5,713,663 A 2/1998 Zandberg et al.
6,484,079 B2 11/2002 Buckelew et al.
6,611,755 B1 8/2003 Coffee et al.
6,893,150 B2 5/2005 Burch
7,730,903 B2 6/2010 Lindblom et al.
8,746,954 B2 6/2014 Cooley et al.
8,911,138 B2 * 12/2014 Cook ..... B01F 29/61 366/19
2002/0015354 A1 2/2002 Buckelew
2007/0185636 A1 8/2007 Cooley et al.
2008/0316856 A1 12/2008 Cooley et al.
2009/0037026 A1 2/2009 Sostaric et al.
2013/0174876 A1 7/2013 Greenwood
2015/0298348 A1 10/2015 Oswald
2018/0361135 A1 * 12/2018 Roberts ..... B65D 77/067

FOREIGN PATENT DOCUMENTS

JP 4467051 5/2010
JP 49-41522 B 5/2012
WO 2016014932 1/2016

* cited by examiner

EXPANDING NOZZLE FOR COMPONENT ADDITIONS IN A CONCRETE TRUCK, AND METHOD AND SYSTEM FOR USE OF SAME

FIELD

Embodiments disclosed herein relate generally to manufacturing of concrete, and more particularly to a nozzle and method for dispensing one or more components such as water and/or liquid chemical admixtures, for example, into a concrete mixer drum.

BACKGROUND

Concrete is made from cement, water, and aggregates, and optionally one or more chemical admixtures. Such chemical admixtures are added to improve various properties of the concrete, such as its rheology (e.g., slump, fluidity), initiation of setting, rate of hardening, strength, resistance to freezing and thawing, shrinkage, and other properties.

In most cases, chemical admixtures are added at the concrete plant at the time of batching. In a "dry batch" plant, the cement, water, aggregates, and chemical admixtures are added from separate compartments (e.g. bins or silos) into the rotatable drum of the ready mix truck, and the ingredients are mixed together. In a "wet batch" or "central mix" plant, all ingredients are combined and fully mixed in a fixed-location mixer, then dumped into a rotatable drum on a truck. A "shrink mix" plant is similar to a "wet batch" or "central mix" plant, with the exception that the ingredients are only partially mixed in the fixed-location mixer, and then mixing is completed within the truck mixer.

In a typical dry batch process, the "head water" is first added, followed by the aggregate and cement, and then followed by the "tail water." The chemical admixture is usually added with the head or tail water. In this way, it is diluted and enough water is present to rinse all chemical admixtures into the mixing drum. In addition, chemical admixture may be added directly on the aggregate as the aggregate is being conveyed to the drum, thus ensuring that all chemical admixtures enter into the drum of the ready mix truck.

The drum of a ready mix truck is typically an oblong shape with an inner wall connecting opposed first and second ends for defining a cavity within which fluid concrete can be contained. One of the two opposed ends is an open end to permit loading and unloading of concrete or components necessary to form concrete. It is mounted at an angle, e.g., an orientation of 5-40 degrees relative to level or horizontal ground, such that the open end is at the top.

Mixing blades or fins are mounted in a helical pattern inside the drum. When the drum is rotated in one direction relative to the blades or fins, the mixing blades push the concrete to the lower end of the drum and cause mixing. When the drum is rotated in the other direction relative to the blades or fins, the mixing blades push the concrete up to and out of the opening. The drum can only be filled partially full with fluid, plastic concrete, because otherwise the concrete will tend to splash out from the truck beyond a certain point.

After batching, the truck moves away from the loading area of the plant and, in the case of dry-batch or shrink mix concrete, completes the initial mixing of concrete, before departing for the jobsite. Frequently, it is desirable to add additional fluid (water or chemical admixture) after the concrete is batched and initially mixed, including up to the time of final discharge at the jobsite. This is be done because some chemical admixtures perform better when added after batching. It is sometimes necessary to add additional fluids to compensate for variations in batching of all ingredients (e.g. too little water added at batching) or changes in concrete properties over time (e.g. loss of flowability and other rheological properties).

It is also known to control the "slump" of concrete in ready-mix delivery trucks by using sensors to monitor the energy required for rotating the mixing drum, such as by monitoring the torque applied to the drum by measuring hydraulic pressure and to adjust fluidity by adding fluid into the mixing drum.

Concrete trucks are commonly equipped with water tanks connected by a hose line or the like directed into the drum opening. In this manner, water can be dispensed into the drum under air pressure in the tank or by pump.

It is less common for chemical admixture tanks to be mounted on trucks. When such admixture tanks are present, however, the tank is typically connected to the same hose line used to discharge water into the drum. The chemical admixture may be dispensed into the water line under air pressure or by tank to the pump.

Thus, both water and admixture can be added to the concrete mixing drum from onboard tanks. The water is usually added by pressurizing the water tank, such as with pressure up to about 60 psi, and opening a valve to commence the water addition. However, as concrete or concrete constituents are added to the concrete truck, the concrete materials tend to stick to the water nozzle, resulting in the unwanted addition of small amounts of cement, sand, rocks, etc. to the nozzle. This is illustrated schematically in FIG. 1, which shows the precarious position where the nozzle is typically located. Concrete is both loaded and discharged through the same opening past the nozzle, and in typical applications, this can cause the water spout to fill with concrete and become unusable. To counteract this, the nozzle should be cleaned each time the truck is loaded, which is time consuming and is rarely done by the field operators.

Concrete can also "stack up" or become very high when the material is stiff. This means that when the concrete is discharged it fills the entire "throat", or opening of the drum. The water and admixture nozzle or nozzles are typically in the way of this discharging concrete and can become completely covered. The inside of the nozzle(s) also can become filled with concrete. These issues cause the water nozzle to lose is effectiveness in adding water and can eventually restrict the water discharge from the nozzle completely.

To remedy these issues, the field operators may resort to the use of hammers or other tools to mechanically remove the concrete from the nozzle, or may drill out the nozzle in an effort to rid them of concrete. The admixture nozzles (when separate from the water nozzle) may have the same issues even though they are considerably narrower; cement paste may still end up restricting the nozzle from the inside and/or the outside.

Accordingly, it is an object of embodiments disclosed herein to provide a nozzle that does not suffer from the foregoing drawbacks.

It is a further object to provide a method of shedding concrete from one or more surfaces of a nozzle.

SUMMARY

Embodiments disclosed herein provide a system and apparatus for introducing one or more liquids into a cavity, such as a concrete mixer drum. In certain embodiments, the apparatus includes a nozzle suitable for dispensing one or more liquids, such as water and/or liquid chemical admixtures, into a cavity such as a concrete mixer drum, and is useful for mixers in plant installations and especially useful in concrete ready-mix delivery trucks. Also disclosed is a method of introducing one or more liquids into a cavity such as a concrete mixer drum.

More specifically, in certain embodiments a nozzle boot is provided, the nozzle boot surrounding a portion of a nozzle shaft or other support member, the boot being expandable and collapsible and having a boot outlet. In some embodiments, the boot is expandable and collapsible in multiple directions, including axially and radially (e.g., relative to the support member). In certain embodiments, the boot surrounds a portion of a nozzle shaft or support member, and is suitable for introducing via the boot outlet, such as by injection, one or more liquids into a cavity, such as a rotatable concrete mixer drum.

In some embodiments, a nozzle assembly can introduce more than one component into the mixer drum independently. In some embodiments, such a nozzle assembly has a nozzle boot, a nozzle shaft, a nozzle shaft inlet, a nozzle boot inlet, a nozzle shaft outlet, and a nozzle boot outlet, wherein the nozzle boot surrounds a portion of the nozzle shaft. In certain embodiments the nozzle shaft functions to both support the nozzle boot, and to introduce a component into a concrete truck mixer drum. Thus, the nozzle shaft inlet is configured to fluidly communicate with a source of a first component to be introduced to the mixer drum, such as a source of admixture, and is in fluid communication with the nozzle shaft outlet. In certain embodiments, the nozzle boot inlet is configured to communicate with a second component to be introduced into a mixer drum, such as a source of water, and is in fluid communication with the nozzle boot outlet. When the second component is allowed to flow into the nozzle boot via the nozzle boot inlet, it causes expansion of the nozzle boot. As a result of that expansion, concrete that has previously adhered to the surface of the nozzle boot (e.g., the outer surface and/or the inner surface) is subjected to tension as the boot expands. Due to the limited tensile strength of concrete, the concrete cracks and breaks away from the nozzle boot, shedding the nozzle of unwanted concrete.

Thus, embodiments disclosed herein removes concerns due to concrete build-up on the nozzle. When the operator adds fluid, the nozzle expands laterally and circumferentially to break concrete off. The force of the fluid flowing through the nozzle creates the expansion needed to break apart the concrete.

In certain embodiments, a system for injecting fluids such as chemical admixture and/or water, into a rotatable mixer drum, such as a rotatable concrete mixer drum, is provided. The system can include a mixer drum that is rotatably mounted to permit rotation about a rotation axis inclined at an orientation of, for example, 5 to 40 degrees relative to level ground and which may have an oblong drum body with an inner circumferential wall connecting opposed first and second ends for defining a cavity within which to contain a fluid, such as fluid concrete. One of the two opposed ends may have an opening to permit loading and unloading of the fluid concrete from the cavity. The system may include a source of a first component such as chemical admixture, and/or a source of a second component such as water. The system may include a nozzle, the nozzle including a support member and a nozzle boot surrounding at least a portion of the support member, the nozzle boot having a nozzle boot inlet and a nozzle boot outlet spaced from the nozzle boot inlet and a volume between the nozzle boot inlet and the nozzle boot outlet, the nozzle boot inlet being in fluid communication with the source of the first component and/or with the source of the second component, and being expandable upon the introduction of the first component into the volume, and collapsible upon the withdrawal of the first component from the volume. The support member may also function to introduce a component into the mixer drum.

DETAILED DESCRIPTION

Figure 1:
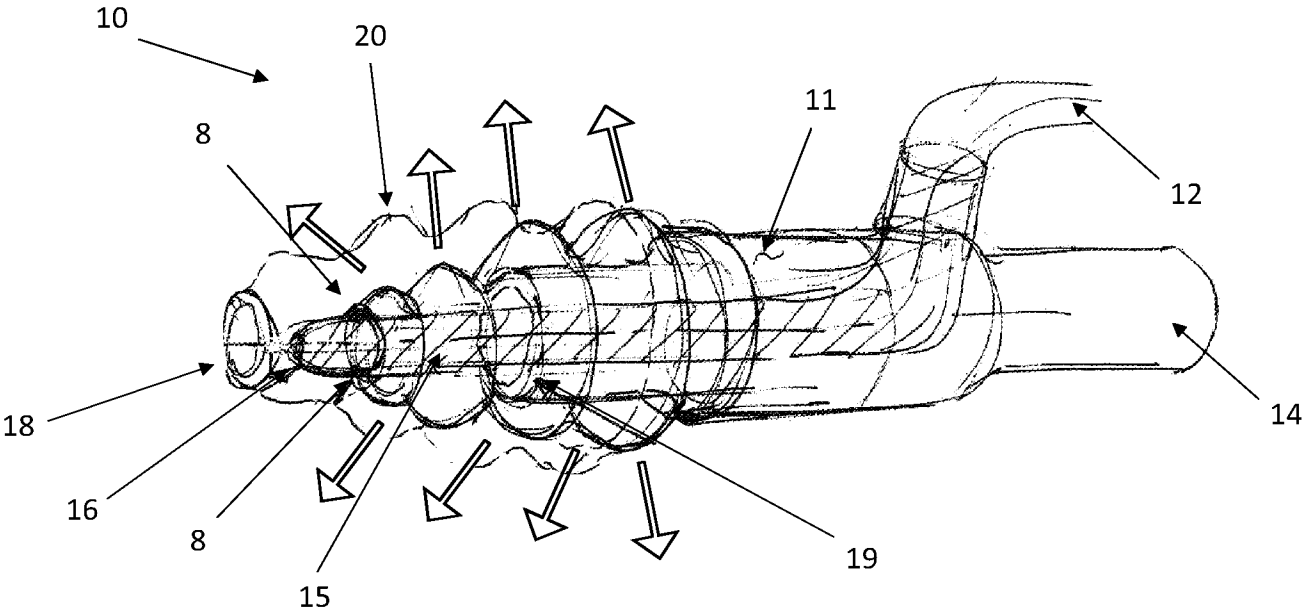
FIG. 1 is a perspective view of a nozzle assembly in accordance with certain embodiments.

A more complete understanding of the components, processes and apparatuses disclosed herein can be obtained by reference to the accompanying drawings. The figures are merely schematic representations based on convenience and the ease of demonstrating the present disclosure, and is, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawing, and are not intended to define or limit the scope of the disclosure. In the drawing and the following description below, it is to be understood that like numeric designations refer to components of like function.

The singular forms "a," "an," and "the" include plural referents unless the context clearly dictates otherwise.

As used in the specification, various devices and parts may be described as "comprising" other components. The terms "comprise(s)," "include(s)," "having," "has," "can," "contain(s)," and variants thereof, as used herein, are intended to be open-ended transitional phrases, terms, or words that do not preclude the possibility of additional components.

It should be noted that many of the terms used herein are relative terms. For example, the terms "upper" and "lower" are relative to each other in location, i.e. an upper component is located at a higher elevation than a lower component, and should not be construed as requiring a particular orientation or location of the structure.

The terms "top" and "bottom" are relative to an absolute reference, i.e. the surface of the earth. Put another way, a top location is always located at a higher elevation than a bottom location, toward the surface of the earth.

The term "concrete" as used herein will be understood to refer to materials including a cement binder (e.g., Portland cement optionally with supplemental cementitious materials such as fly ash, granulated blast furnace slag, limestone, or other pozzolanic materials), water, and aggregates (e.g., sand, crushed gravel or stones, and mixtures thereof), which form a hardened building or civil engineering structure when cured. The concrete may optionally contain one or more chemical admixtures, which can include water-reducing agents, mid-range water reducing agents, high range water-reducing agents (called "superplasticizers"), viscosity modifying agents, corrosion-inhibitors, shrinkage reducing admixtures, set accelerators, set retarders, air entrainers, air detrainers, strength enhancers, pigments, colorants, fibers for plastic shrinkage control or structural reinforcement, and the like. Exemplary concrete mixing drums contemplated for use in the present invention include those that are customarily mounted for rotation on ready-mix delivery trucks or on stationary mixers that may be found in mixing plants. Such mixing drums have an inner circumferential wall surface upon which at least one mixing blade is attached to the inner surface so that it rotates along with the mixing drum and serves to mix the concrete mix, including the aggregates contained within the mix. For example, the rotatable concrete mixer drum may be mounted to permit rotation about a rotation axis inclined at an orientation of 5-40 degrees relative to level ground, and may have an oblong drum body with an inner circumferential wall that connects a first closed end and a second end that has an opening for loading and unloading concrete from the drum.

Turning now to FIG. 1, there is shown an exemplary nozzle assembly 10 in accordance with certain embodiments. In the embodiment shown, the nozzle assembly 10 is capable of independently introducing two separate components into a mixer drum. The nozzle assembly 10 may be aimed and mounted with respect to a concrete mixer drum 5 cavity opening such that the nozzle aperture or shaft outlet 16 of the nozzle assembly 10 is focused into the drum cavity to introduce one or more ingredients or components of concrete into that cavity (FIG. 2A). In the embodiment shown, the nozzle assembly 10 includes a shaft inlet 12 and a nozzle boot inlet 14. For purposes of discussion, this inlet 14 will be referred to as the nozzle boot inlet, although it will be appreciated that the actual location of the inlet 14 need not be part of the nozzle boot, just in fluid communication with it. That is, the inlet 14 may be formed in a body member 11 to which the nozzle boot is attached, as shown in FIG. 1. The nozzle boot 20 has a nozzle boot outlet 18 spaced from the nozzle booth inlet 14. The shaft inlet 12 may be in fluid communication with a source of a first component such as admixture (not shown) or other concrete ingredient or additive to be introduced by the nozzle assembly 10 to a cement truck mixer drum, for example, such as with a conduit, hose, pipe, or the like, which can be rigid or flexible. A nozzle aperture or shaft outlet 16 in the nozzle assembly 10 is in fluid communication with the source of the first component via shaft 15 or the like, which is preferably rigid, has an internal bore, and extends axially in the nozzle assembly 10. The shaft outlet 16 is preferably smooth, and may be made of HDPE, no-stick plastic or a coated material such as PTFE (TEFLON®). The nozzle boot inlet 14 may be in fluid communication with a source of a second component, such as water (not shown) or other additive or component to be introduced by the nozzle assembly 10 to a cement truck mixer drum, for example, such as with a conduit, hose, pipe, or the like, which can be rigid or flexible. The source or sources of the component or components may be pumped or pressurized to flow to the nozzle assembly 10.

In certain embodiments, nozzle boot 20 surrounds a portion of the shaft 15, and is coupled to the nozzle body member 11 at or near one end, such as by adhesion, and/or mechanically such as with a clamp or the like (not shown).

The nozzle boot 20 may be permanently fixed to the nozzle body member 11, or removably attached so that it can be easily replaced with a new nozzle boot 20 from time to time. The nozzle boot 20 and nozzle body member 11 can also be constructed as a single integral piece. In certain embodiments, the nozzle boot 20 forms a water nozzle that surrounds and is at least partially coaxial with the shaft 15. This reduces the overall size of the nozzle.

In certain embodiments, the nozzle boot 20 is expandable and collapsible. FIG. 1 illustrates nozzle boot 20 in both a collapsed state (20A) and in an expanded state (20) upon the introduction into the internal volume of nozzle boot 20 of the second component such as a gas or fluid, e.g., water. In the expanded state, the nozzle boot 20 expands in multiple directions relative to the shaft 15, as depicted by the arrows in FIGS. 1 and 4, including axial expansion, from for example, a position where the shaft outlet 16 extends axially beyond the free end of the nozzle boot 20A, to a position where the free end of the nozzle boot 20 extends axially beyond the shaft outlet 16. In some embodiments the direction of nozzle boot expansion also includes radial expansion relative to the shaft 15.

Figure 3:
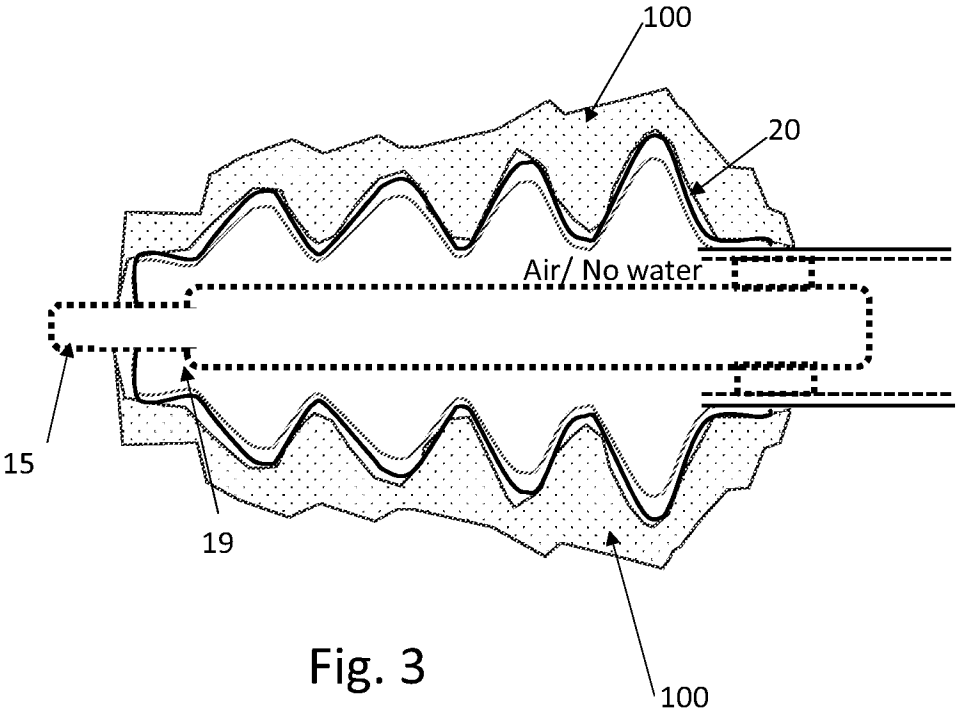
FIG. 3 is a cross-sectional view of a nozzle assembly in accordance with certain embodiments showing the outer surface of the nozzle boot covered with concrete.
Figure 4:
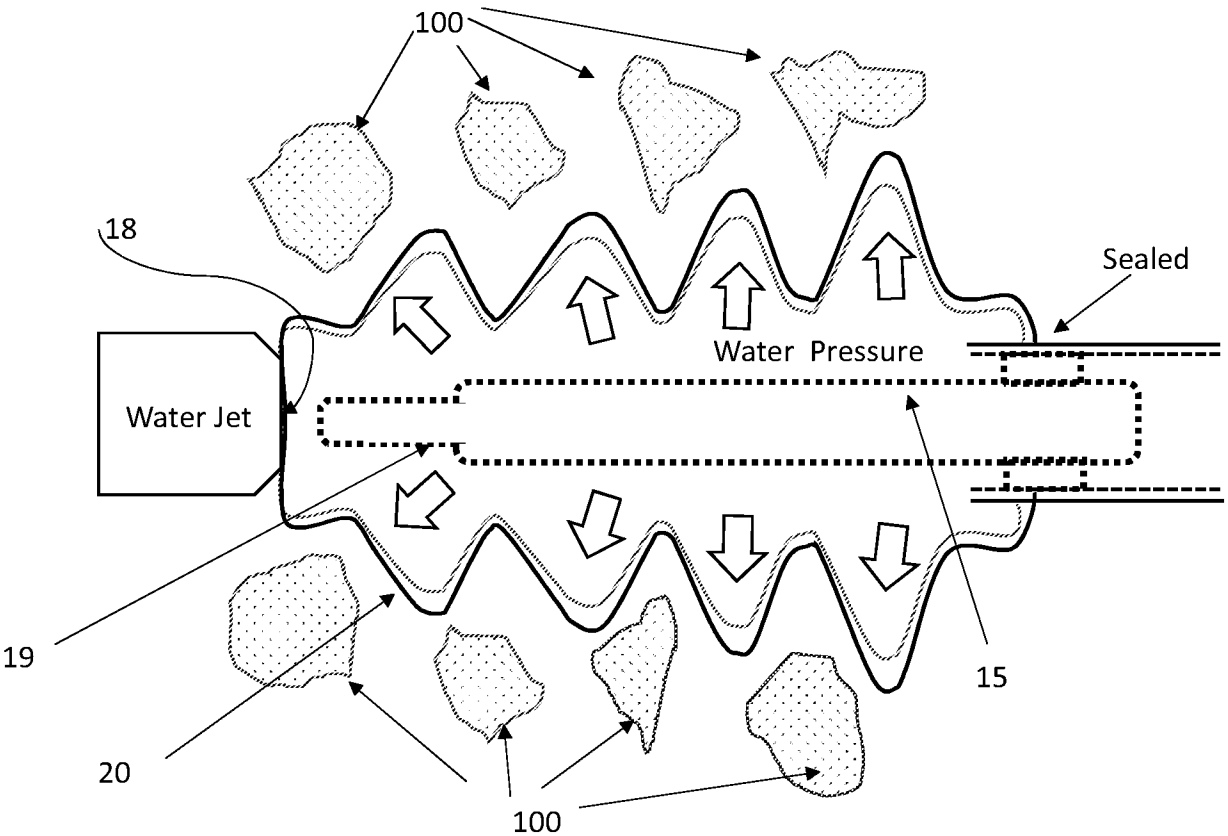
FIG. 4 is a schematic diagram showing a nozzle assembly in accordance with certain embodiments with the boot expanded by water pressure, causing shedding of concrete off of the outer surface of the boot.

When concrete 100 has adhered to the nozzle boot 20, such as the outer surface of the nozzle boot 20 as shown in FIG. 3, the expansion of the nozzle boot 20 creates tensile stress on concrete 100 that has coated or adhered to the surface (the inside and/or outside surface) nozzle boot 20, and is sufficient to cause that concrete to crack and fall off the nozzle boot 20, since the tensile stress caused by the expansion of the nozzle boot 20 overcomes the relatively weak tensile strength of the concrete 100 (shown diagrammatically in FIG. 4).

Suitable materials of construction for the nozzle boot 20 are materials that provide the necessarily elasticity enabling the nozzle boot 20 to repeatedly expand and contract, such as elastomeric materials, high density polyethylene (HDPE) and non-stick plastic.

In some embodiments, the nozzle boot 20 may be a bellows, such a flexible material whose volume can be changed, e.g., expanded, such as by the introduction of water or gas (e.g., air) under pressure, or compressed, such as by ceasing the introduction of water or gas under pressure. The bellows can have a concertina or accordion shape. For example, as shown in FIG. 6A, the nozzle boot 20 can have multiple regions or sections 20*a*, 20*b*, 20*c*, etc., each having a respective intermediate region 20*a*', 20*b*', 20*c*' having the largest outer diameter of that region or section (in both the collapsed state and the expanded state), and gradually transitioning or tapering to regions of smaller and smaller diameter in both axial directions (i.e., towards and away from the nozzle boot outlet 18). The regions 20*a*', 20*b*' and 20*c*' can have the same outer diameter as one another (in both the collapsed state or expanded state) or can have different outer diameters relative to each other.

Suitable pressure that may be applied to the nozzle boot 20 to expand the nozzle boot is preferably about 2 psi, and may be as high as about 60 psi.

Figure 2B:
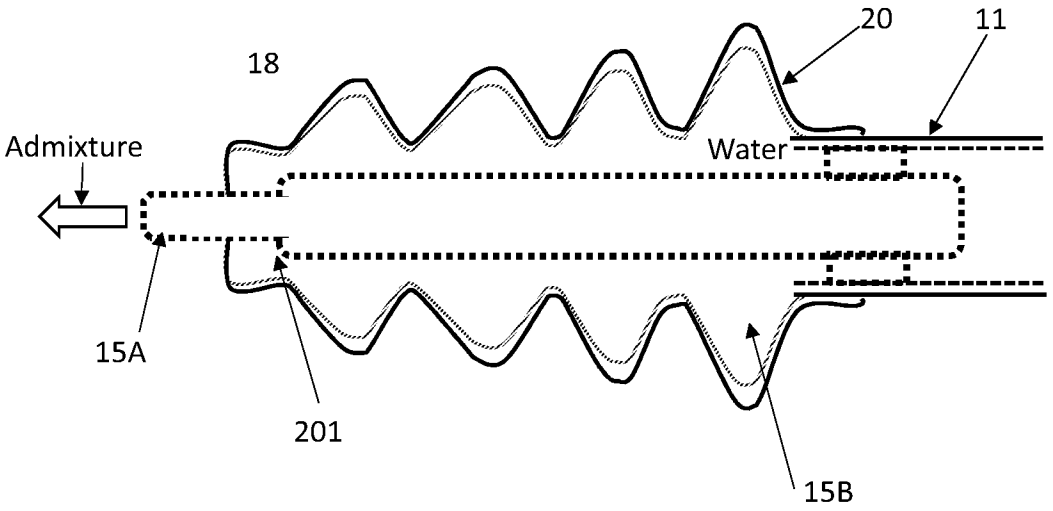
FIG. 2B is a cross-sectional view of a nozzle assembly in accordance with certain embodiments, showing a stop formed on the nozzle body that prevents the boot from excessive axial retraction.
Figure 2A:
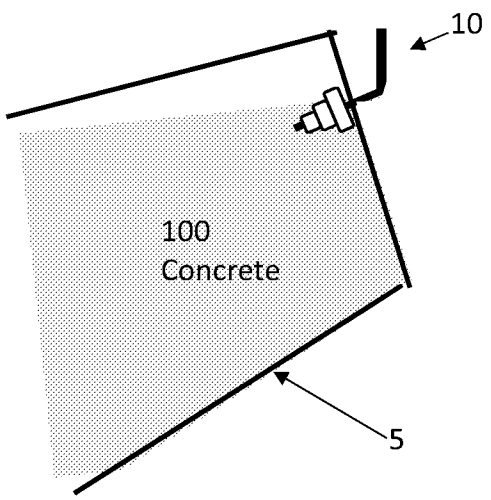
FIG. 2A is a diagram depicting common positioning of a nozzle in a concrete truck drum.

As shown in FIG. 2B, the shaft 15 can include a region of smaller diameter 15A and a region of larger diameter 15B, so that the region transitioning from the smaller to larger diameter regions forms a shoulder 19. The nozzle boot 20 can be configured and positioned around the shaft 15 such that the shoulder 19 provides a stop, minimizing the extent to which the nozzle boot 20 retracts axially (e.g., at a point 201 of the nozzle boot 20, the location of which along the axial length of the nozzle boot 20 is not particularly limited) as it transitions from an expanded state to a contracted state. The stop also provides a barrier that prevents discharging concrete from entering and filling the nozzle, which could ultimately render the nozzle unusable were that to occur. However, should there be any concrete adhered to the inside surface of the nozzle boot 20, expansion of the nozzle boot 20 will also cause that concrete to break away from the surface, and ultimately be expelled from the nozzle boot 20, such as upon introduction of fluid (e.g., air) into the boot 20.

In certain embodiments, the outlet of the nozzle boot 20 has an inside diameter only slightly larger than the outside diameter of a portion of the shaft outlet 16, so as to create a slight friction fit for the nozzle boot 20 on the shaft 15. For example, as seen in FIG. 1, one or more protrusions 8 can be formed on the outer surface of the nozzle area that create a restriction that allows pressure to build up in the internal volume of the nozzle boot 20. This helps ensure that when the second component (e.g., water) is introduced into the internal volume of the nozzle boot 20 under pressure, the pressure rises, causes the nozzle boot 20 to expand in multiple directions, and causing the second component to flow out of the nozzle outlet 18 of the nozzle boot 20. Preferably the end of the shaft 15 is bullet or cone shaped, to facilitate the nozzle boot 20 sliding back and forth over the shaft 15 as it expands and contracts.

Figure 5:
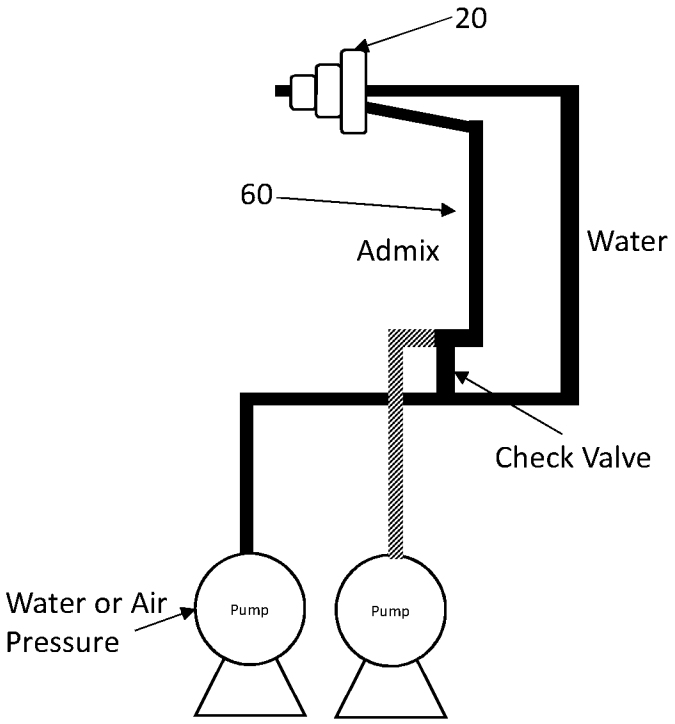
FIG. 5 is a schematic view of a purge system for purging one or more feed lines in accordance with certain embodiments.

As shown schematically in FIG. 5, in some embodiments the source of the second component can fluidly communicate with the feed line that carries the first component. For example, in an embodiment where feed line 60 may be placed in fluid communication with a first component such as admixture, a check valve 65 or the like may be used to allow the feed line 60 to instead be placed in fluid communication with the second component such as water or air. This allows for the flushing or purging of the feed line 60 with the second component, and the flushing or purging of the components that are in fluid communication with it that are downstream of the check valve 65.

Figure 6B:
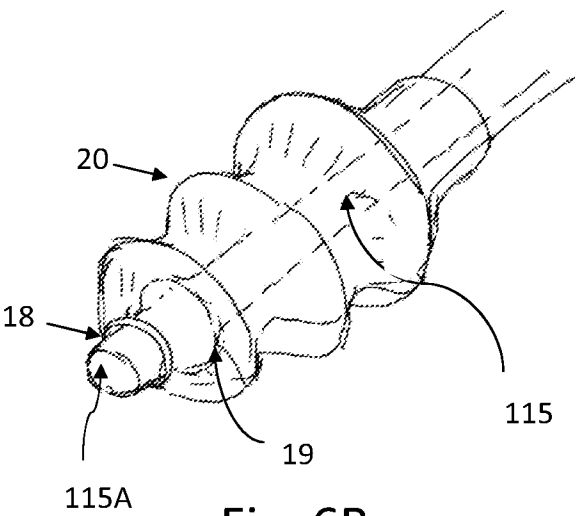
FIG. 6B is a perspective view of a nozzle boot in a collapsed state supported by a support member in accordance with certain embodiments.
Figure 6A:
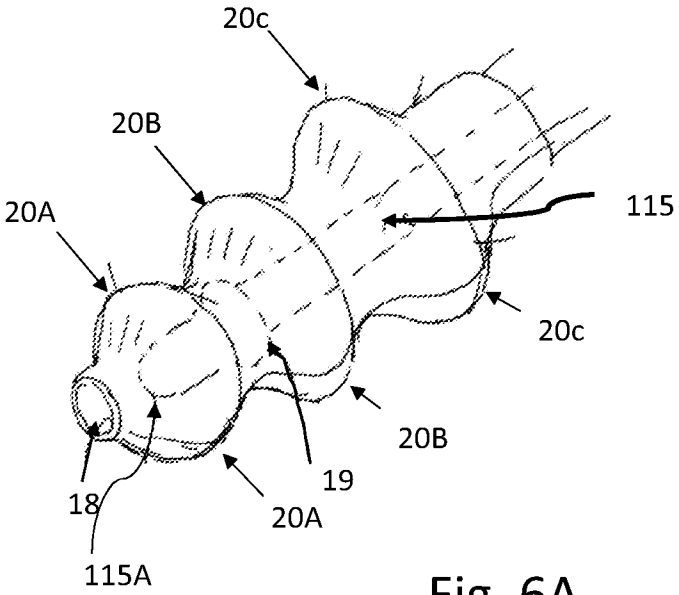
FIG. 6A is a perspective view of a nozzle boot in an expanded state supported by a support member in accordance with certain embodiments.
Figure 7:
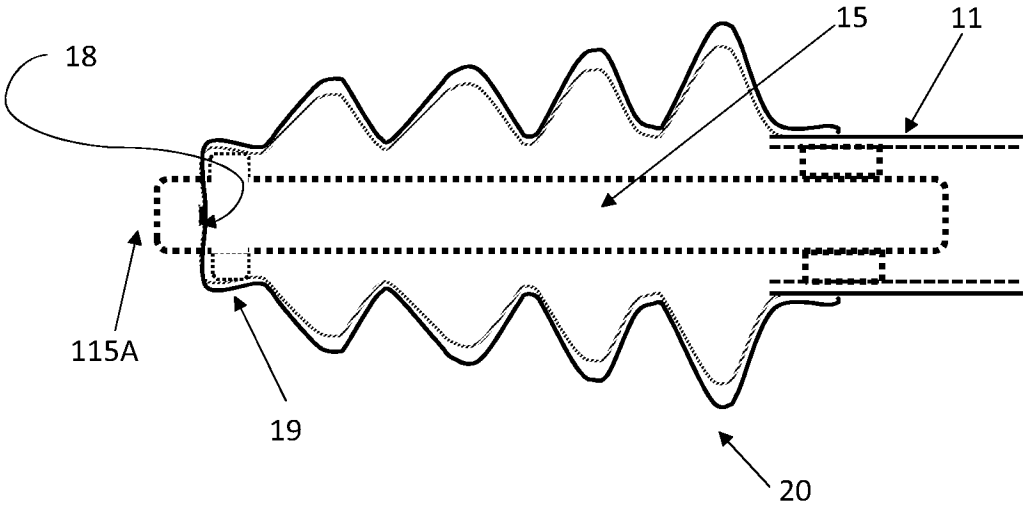
FIG. 7 is a cross-sectional view of a nozzle boot in an expanded state supported by a support member in accordance with certain embodiments.
Figure 8:
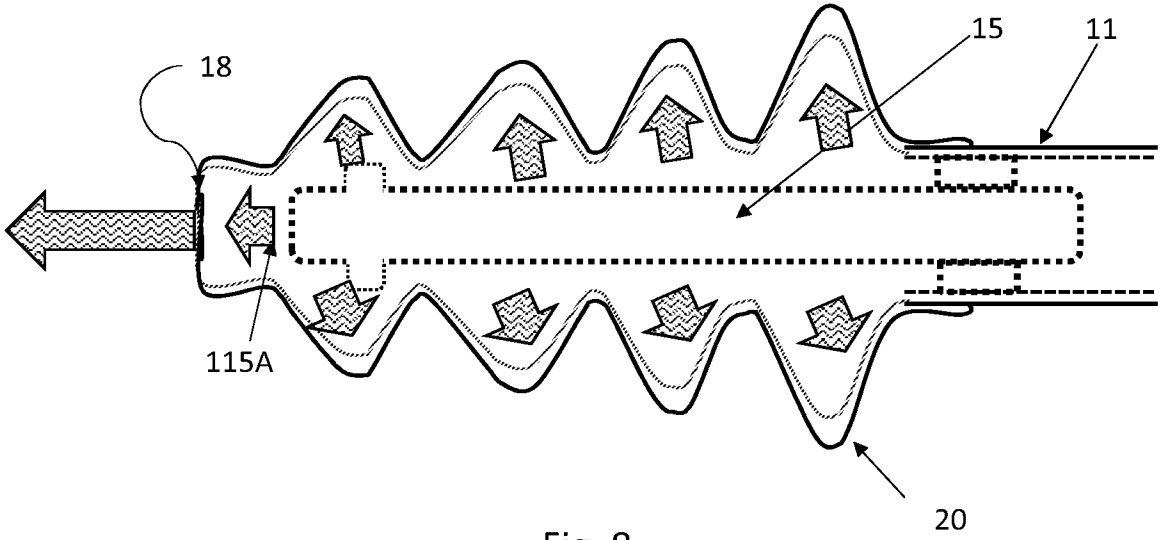
FIG. 8 is a perspective view of a nozzle boot in an expanding state supported by a support member in accordance with certain embodiments.

FIGS. 6A, 6B and 7 illustrate an embodiment where a support member does not itself include an outlet; the support member functions to support the nozzle boot 20 but does not function to introduce a component to the concrete mixer drum (a separate nozzle may be used for that purpose). In FIGS. 6A and 7, the nozzle boot 20 is shown in an expanded state, and thus extends axially beyond the proximal end 115A of the support member 115. In FIG. 6B, the nozzle boot 20 is shown in a collapsed state, and thus the proximal end 115A end of the support member 115 extends axially beyond the nozzle boot 20. In certain embodiments, the support member 115 includes an annular shoulder 119 that, like shoulder 19 of shaft 15, functions as a stop to prevent further axial retraction of the nozzle boot 20. FIG. 8 is a diagrammatic view of the nozzle boot 20 in the expanded state, with the arrows depicting directions of expansion upon introduction of fluid into the internal volume of the nozzle boot 20 about the support member 115.

EXAMPLE

Figure 9:
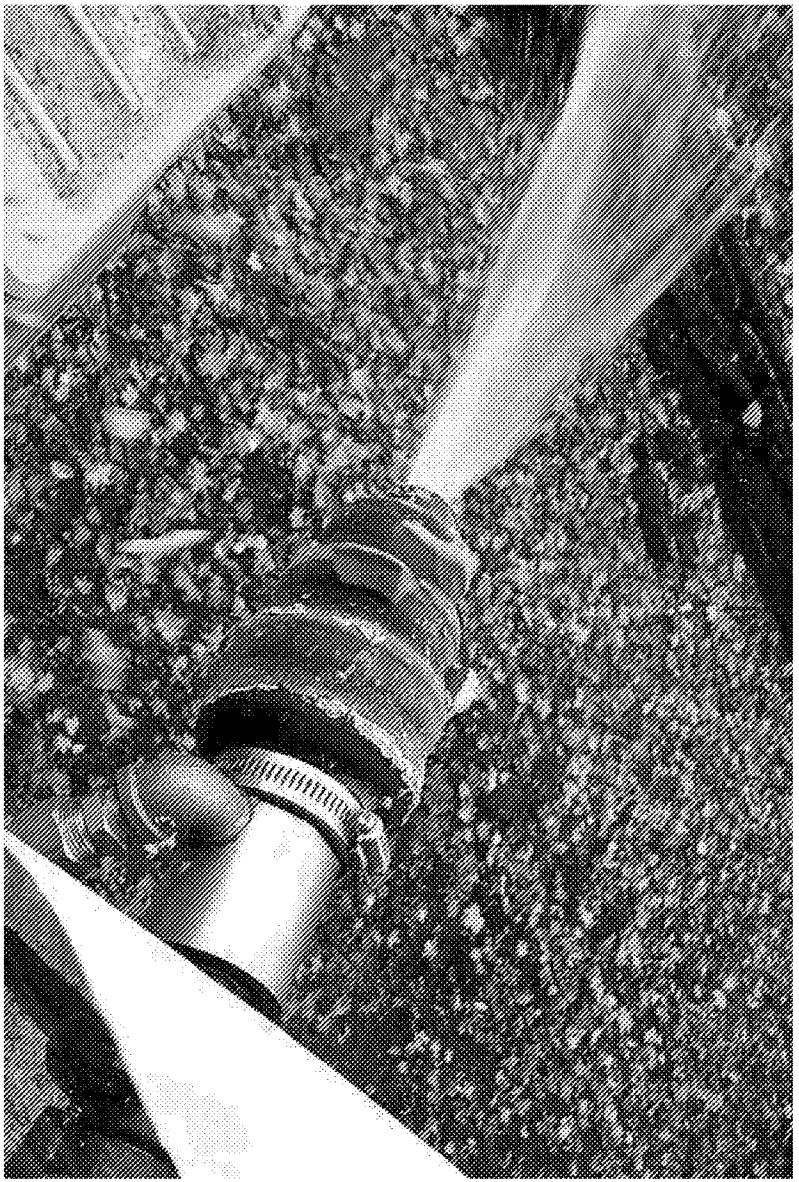
FIG. 9 is an illustration of a nozzle in operation, showing concrete breaking off the nozzle surface.

A nozzle was tested in the lab using an AC pump to simulate the water pressure of a concrete mixer truck. The external bellows of the nozzle was constructed out of a Porsche 911 CV joint. The internal shaft was plastic, which is not suitable for commercial applications but is suitable as a mock up for testing purposes. The entire assembly had the correct components of an internal shaft for support which acted as an admix nozzle. The bellows and stops were installed as shown in FIG. 9.

The first test system was covered in hydraulic cement (not typical for real production of concrete) and allowed to sit for one day. Hydraulic cement hardens very quickly but does not contain the rest of the ingredients of concrete (e.g., sand, stone). After the cement was allowed to harden, the pump was turned on and the bellows expanded in multiple directions, shattering the hardened cement, which caused it to fall off the bellows.

Further tests were conducted using conventional ~3500 psi compressive strength concrete using 3 inch aggregate, 517 pounds per yard of cementitious materials. The concrete was produced in the afternoon of day 1 and packed onto the nozzle and allowed to sit for one full day before testing. This is an extreme case in that most use cases the nozzle will be expanded at least once at the end of the day. The pressure was monitored to ensure that it did not exceed the pressures seen during normal concrete operations. The pressure was measured at the nozzle at 8 psi. Upon expansion of the bellows, the concrete shattered and fell off of the bellows.

Even further tests were conducted to simulate the concrete hitting the nozzle when exiting the drum. The nozzle was pushed into a bucket of concrete 5 times and then allowed to sit for 1 day. The water was then shot though the system and the results were the same. The stop on the internal shaft of the nozzle kept the concrete from entering the inside of the bellows and when test was complete the concrete fell of the nozzle completely.

In all cases, the inside shaft and the external bellows were examined for concrete build up. Only minimal remained, mostly just the dust of hardened concrete.

What is claimed is:

1. A nozzle, comprising:

a support member comprising a shaft having a shaft inlet and a shaft outlet spaced from said shaft inlet; and a nozzle boot surrounding at least a portion of said shaft of said support member, said nozzle boot having a nozzle boot inlet and a nozzle boot outlet spaced from said nozzle boot inlet and a volume between said nozzle boot inlet and said nozzle boot outlet, said nozzle boot comprising a bellows that is expandable axially and radially relative to said shaft of said support member upon the introduction of water under pressure into said volume between said nozzle boot inlet and said nozzle boot outlet, and said bellows further being collapsible axially and radially relative to said shaft of said support member when water pressure is withdrawn; and said shaft having a shoulder stop that provides a barrier that prevents concrete from entering and filling the nozzle boot bellows.

2. The nozzle of claim 1, wherein the axial expansion of said nozzle boot bellows is from a position where the shaft outlet extends axially beyond the end of the nozzle boot to a position where the free end of the nozzle boot extends axially beyond the shaft outlet.

3. The nozzle of claim 1, wherein said nozzle boot bellows comprises regions of smaller outer diameters and regions of larger outer diameters in the collapsed state or expanded state, wherein the larger outer diameters have the same outer diameter as one another or have different outer diameters relative to one another.

4. The nozzle of claim 1, wherein said support member shaft a shoulder stop minimizes axial movement of said nozzle boot as said nozzle boot is transitioning from an expanded state to a collapsed state.

5. The nozzle of claim 1 wherein the shaft has an end that is bullet- or cone-shaped to facilitate the nozzle boot sliding back and forth over the shaft as the nozzle boot expands from said introduction of water under pressure and collapses when water under pressure is withdrawn.

6. The nozzle of claim 1, wherein said shaft is in communication with a source of chemical admixture.

7. The nozzle of claim 1, wherein said nozzle boot is in communication with a source of water under pressure for expanding the nozzle boot.

8. The nozzle of claim 1, wherein said nozzle boot bellows is positioned coaxially with respect to said shaft, said shaft shoulder stop minimizes the extent to which the nozzle boot retracts axially as the nozzle boot transitions from an expanded state to a contracted state.

9. A method of removing concrete from a nozzle surface, comprising providing the nozzle of claim 1 having concrete adhered to a surface of the nozzle boot bellows, and introducing water under pressure into said volume between said nozzle boot inlet and said nozzle boot outlet, thereby to expand the nozzle boot bellows axially and radially relative to said support member and to shed to concrete adhered to said surface.

10. A system for injecting fluids into a rotatable mixer drum, comprising:

a mixer drum rotatably mounted to permit rotation about a rotation axis inclined at an orientation of 5 to 40 degrees relative to level ground and which has an oblong drum body with an inner circumferential wall connecting opposed first and second ends for defining a cavity within which to contain a fluid, one of said two opposed ends having an opening to permit loading and unloading of material from said cavity;

a source of water under pressure;

the nozzle of claim 1 connected to said source of said water under pressure thereby to enable expansion of said nozzle boot bellows when said water under pressure is introduced into said volume between said nozzle boot inlet and said nozzle boot outlet, and to enable collapse of said nozzle boot bellows when said water under pressure is withdrawn from said volume between said nozzle boot inlet and said nozzle boot outlet.

11. The system of claim 10, wherein said mixer drum is a concrete mixer drum.

12. The system of claim 11, further comprising a source of a chemical admixture, said shaft inlet being in fluid communication with said source of said chemical admixture.

13. A system for injecting water and chemical admixture fluid into a rotatable concrete mixer drum, the system comprising: a mixer drum that is rotatably mounted to permit rotation about a rotation axis inclined at an orientation of 5 to 40 degrees relative to level ground, the mixer drum having an inner circumferential wall connecting opposed first and second ends for defining a cavity within which to contain a fluid concrete, one of the two opposed ends having an opening to permit loading and unloading of fluid concrete from the mixer drum cavity, the system comprising a source of a chemical admixture and a source of water, the system further comprising a nozzle including a support member and a nozzle boot surround at least a portion of the support member, the nozzle boot having a nozzle boot inlet and a nozzle boot outlet spaced from the nozzle boot inlet and a volume between the nozzle boot inlet and the nozzle boot outlet, the nozzle boot inlet being in fluid communication with the source of water under pressure and being expandable upon the introduction of water under pressure into the volume, and collapsible upon withdrawal of water under pressure from the volume, and the support member effective for introducing chemical admixture into the concrete mixer drum.

14. The system of claim 13 wherein the nozzle boot comprises a bellows which is expandable and collapsible axially and radially relative to said support member, said nozzle boot bellows comprising regions of smaller outer diameters and regions of larger outer diameters in the collapsed state or expanded state, wherein the larger outer diameters have the same outer diameter as one another or have different outer diameters relative to one another, the nozzle boot bellows effective for shedding concrete that is hardened on the nozzle boot.

* * * * *